US008872722B2

(12) United States Patent
Onweller et al.

(10) Patent No.: US 8,872,722 B2
(45) Date of Patent: Oct. 28, 2014

(54) RECEIVER COVER

(76) Inventors: Arthur E. Onweller, Evergreen, CO (US); Christopher Lee Onweller, Evergreen, CO (US)

( * ) Notice: Subject to any disclaimer, the term of this patent is extended or adjusted under 35 U.S.C. 154(b) by 813 days.

(21) Appl. No.: 13/047,776

(22) Filed: Mar. 14, 2011

(65) Prior Publication Data

US 2011/0193763 A1 Aug. 11, 2011

Related U.S. Application Data

(63) Continuation-in-part of application No. 12/254,826, filed on Oct. 20, 2008, now abandoned.

(51) Int. Cl.
*H01Q 1/42* (2006.01)
*H01Q 19/17* (2006.01)

(52) U.S. Cl.
CPC . *H01Q 1/42* (2013.01); *H01Q 19/17* (2013.01)
USPC ..... 343/872

(58) Field of Classification Search
USPC ..... 343/872
See application file for complete search history.

(56) References Cited

U.S. PATENT DOCUMENTS

| | | | |
|---|---|---|---|
| 5,451,972 | A | 9/1995 | Franklin |
| 5,528,253 | A | 6/1996 | Franklin |
| 5,729,241 | A | 3/1998 | Ergen et al. |
| 5,798,735 | A | 8/1998 | Walton, Jr. |
| 5,815,125 | A | 9/1998 | Kelly et al. |
| 5,940,047 | A | 8/1999 | Pfnister |

*Primary Examiner* — Graham Smith
(74) *Attorney, Agent, or Firm* — Roger A. Jackson

(57) ABSTRACT

An apparatus and method for a receiver cover to partially envelope a receiver, wherein the receiver has a non-symmetrical outer edge portion. The receiver cover includes a flexible panel having a peripheral margin portion with the peripheral margin portion being adjacent to the receiver non-symmetrical outer edge portion. The receiver cover also including structure for removably engaging the panel to the non-symmetrical outer edge portion of the receiver.

8 Claims, 11 Drawing Sheets

RECEIVER COVER

RELATED APPLICATION

This continuation in part (CIP) patent application claims priority from U.S. patent application Ser. No. 12/254,826 filed on Oct. 20, 2008 now abandoned by Arthur E. Onweller of Evergreen, Colo., US.

TECHNICAL FIELD

The present invention generally relates to a cover for helping to protect a receiver from undesirable interference with a receiver signal. More particularly, the present invention is a cover that partially encases a receiver dish to help shield a signal reflector surface from environmental effects that can be detrimental to the reflector surface performance.

BACKGROUND OF INVENTION

Many households and businesses use satellite dishes to receive a television signal, with a growing number of households using the next generation satellite dishes, for receiving a high-definition television signal being defined as a HDTV satellite dish. A prior generation satellite dish being defined as a non-high definition television is termed a TV satellite dish that typically has one horn which receives a signal being reflected off a round or symmetrical parabolic dish signal reflector. Whereas, the HDTV dish signal reflector can have different configurations, for example, the HDTV satellite dish can have three horns in three different positions for receiving multiple signals being reflected off a non-symmetrical dish signal reflector, as opposed to the prior generation satellite TV symmetric dish signal reflector that out of necessity must focus the reflected dish signal to a concentrated zone for typically a single receiver in the horn to collect the signal. The HDTV non-symmetrical dish allows for multiple focus areas of the reflected dish signal for collection by multiple horns, typically being three horns as previously described. The usual position for the satellite dish is normally in an outside environment on the roof or side of a building oriented toward an applicable satellite that is normally having a southward orientation (from the northern hemisphere) as most satellites are in geosynchronous orbit (fixed over a single position on the earth) adjacent to the earth's equator for the dish to receive a direct satellite signal.

A common drawback with outdoor satellite dishes is that the weather or other normal environmental conditions can interrupt, distort, or disable the desired signal reflection from the dish surface that is desirably free from any impediment upon a smooth, clean, and dry reflecting surface of the dish. A further environmental issue is in sunny climates having to do with the problem of sun rays reflecting from the dish surface and concentrating upon the horn potentially causing solar overheating and possible heat damage to the horn components, in addition to thermal distortion of the dish that can make signal reflection non-optimum. Due to the location, the angle, and the shape of the satellite dish, various weather or environmental conditions can accumulate on the dish reflector side, which unfortunately due to its concave nature tends to coalesce and retain undesirable articles such as snow, ice, freezing rain, leaves, dirt/mud buildup, animal excrement, and the like, and therefore disrupting the signal by taking away from the ideal of the previously desirable smooth, clean and dry reflecting surface of the dish. When this happens, the satellite dish user has to usually climb to the location of the dish, clean the debris off the reflecting surface of the dish, and then climb back down; not only is this burdening, it is also dangerous, especially in inclement weather conditions.

It is well recognized in the prior art, especially in the area of symmetric satellite dishes the aforementioned primary problem of debris collection as against the concave surface of the satellite signal reflector dish surface, with a number of solutions being put forth. The primary and most popular solution is with a flexible cover that allows satellite signals through, however, in effect keeping the concave portion of the satellite reflector dish covered and dry from various environmental conditions as previously described and further diffusing the sun rays to not concentrate upon the horn, wherein the cover is stretched across the outer edges of the rim or dish periphery forming a drum skin type expanse of flexible material that spans across the concave portion of the satellite dish, that can further add beneficial structural strength to the dish. Outside of the previously described primary solution it is also recognized that heaters, blowers, or a fluid scrubber could all be built into the dish to help automatically keep the concave surface dry, smooth, and clean, however, these solutions have been generally disfavored due to their added complication, potential interference with satellite signals, and consumption of additional energy. Further, it is also known that especially in the case of the flexible satellite dish cover, it must be securely fastened and stretched tight relative to the dish to withstand the effects of wind, snow weight, and the like.

Looking to the prior art in this area starting with the satellite dish flexible covers that are for a symmetrical shaped concave shaped dish that typically has a round outer periphery, wherein the cover is stretched across the concave portion of the dish with the cover secured to the round outer periphery of the dish in some manner. Starting with U.S. Pat. No. 5,940,047 to Pfnister, disclosed is a satellite antenna cover for the dish, arm, and horn that is mounted to the arm. The dish cover in Pfnister is separate from the arm cover and the horn cover, thus allowing the separate dish cover to form a drum skin like (flat) cover. Furthermore, in Pfnister the dish cover securing means includes a strap having a first end secured to the dish cover and a second free end with the means further including a ring to secure to the dish cover and the second end of the strap that is insertable through the ring and releasably connected to the first end of the strap to releasably secure the strap to the ring. The arm cover securing means in Pfnister includes a hook and loop fastener mechanism and the arm cover is secured to the horn cover by stitching the arm cover to the horn cover by threads with the horn cover is constructed from a transparent material, column 2, lines 8-26. Pfnister claims to have the benefit of having three close fitting pieces, namely the dish cover, the arm enclosure cover, and the horn glove cover that allows for a close fit on these three pieces, thus facilitating protection of the arm and horn without a bulky "tent" type single piece cover for all three pieces. Pfnister, however, only teaches use of the dish cover with a round periphery dish by having to have the cover conform closely to the dish, see column 4, lines 11-15.

Continuing, in the dish flexible cover prior art, looking at U.S. Pat. No. 5,528,253 to Franklin disclosed is a "tent" type satellite dish utility cover formed of moderately stretchable polyester fabric wherein a single piece of fabric covers the dish, the arm, and the horn, with the cover having a peripheral hem through which is threaded a cord having its two ends extended through an opening in the hem and connected to a manually operated tightening and locking mechanism for drawing the cord taut and maintaining the cord taut to capture the edges of a satellite dish and secure the cover thereon. This patent, being the Franklin '253 is a continuation in part of the Franklin '972 (described below) by having the added feature of the tent type cover over the dish, arm, and horn all together. The cover in Franklin '253 is placed on a satellite antenna dish with the edges of the cover overlapping the edges of the dish and the cord is drawn taut or tight and secured, thereby firmly attaching the cover of the face of the antenna dish, so that the dish, arm, and receiver horn is protected from precipitation and wind-blown matter by the cover, column 2, lines 36-55. While Franklin '253 has the beneficial feature of the one-piece cover for the dish, arm, and horn, it also has the drawback of having more surface area that is exposed to wind force and snow weight that can add considerable stress to the dish, arm, and horn assembly, and especially to the arm and horn, which are not necessarily designed to withstand the added load from the tent type cover, potentially resulting in failure of the arm and/or horn.

Moving ahead in the prior, art in U.S. Pat. No. 5,815,125 to Kelly et al. disclosed is a satellite dish cover that is similar to Franklin '253 in that a sheet of material constructed and arranged for being disposed over the dish, arm, and feeder horn comprising again a tent like structural shape for the cover, having the previously mentioned disadvantages of Franklin '253. In Kelly et al., the cover's primary body panel wraps around the dish, arm, and feeder horn and a secondary body panel extends from the dish to the support of the satellite dish assembly. Velcro or hook and loop fasteners are used in Kelly et al., to affix the end portion for cinching the primary body panel about the satellite dish assembly. The dish cover in Kelly et al., accommodates satellite dishes of varying shapes and sizes, as it is basically loosely draped over the entire dish, arm, and horn assembly being somewhat retained by hook and loop fasteners, is electromagnetically transparent so that digital signals can be received, and is fabricated from rugged, durable material that is lightweight and resistant to sunlight, ozone, temperature extremes, wind, rain, and snow, column 1, lines 66-67 and column 2, lines 1-14 and 35-48. However, Kelly et al., as in Franklin '253 will have potential problems with the snow and wind loading on the tent like cover as against the dish, arm, and horn assembly which are not necessarily designed to withstand the additional loads as imposed by the tent type cover.

Further, in the satellite dish cover prior art area in U.S. Pat. No. 5,451,972 to Franklin disclosed is a satellite antenna dish cover comprising a circular sheet of suitable fabric material having a central opening to accommodate a conventional antenna receiver and feed unit. Note that Franklin '972 is the parent to Franklin '253, previously discussed. The circular sheet in Franklin '972 is provided with a hem around its periphery which encloses a heavy drawstring or draw-cord. The stretchability and flexibility of the material in Franklin '972 may be placed over the face of the antenna dish with the antenna feed passing through the opening in the center of the cover and with the periphery of the cover extending beyond the edges of the antenna dish preliminarily to pulling the draw-cord tight and causing the draw-cord and hem of the cover to capture the edge of the dish to firmly secure the cover, column 1, lines 16-29. Although Franklin '972 does not have the attendant problems previously discussed in the tent type cover, it is limited to a symmetrically round dish outer periphery due to the constant pulling action of the draw-cord to secure the cover to the dish.

Continuing, in the satellite dish cover prior art in U.S. Pat. No. 5,798,735 to Walton Jr. disclosed is a hot air de-icing system for a satellite antenna with a cover, with the cover being configured to accommodate the front opening of the antenna, and a heating system that is set up to heat the cover so that the cover is maintained at a temperature which reduces the accumulation of ice and snow upon the cover. Thus, Walton, Jr. while being a conventional one piece drum skin type dish cover further identifies the problem of ice and snow buildup upon the cover itself, wherein the heating system is preferably mounted on the back side of the antenna and provides heated air to the space between the concave reflecting surface of the antenna or dish and the outside cover so as to maintain the cover at a temperature above freezing. The closed-loop heating system in Walton, Jr. includes a blower which blows heated air into the space between the antenna and the cover via an intake tube, and an exhaust tube that collects air from the space between the antenna and the cover and provides it to the heater, to prevent the accumulation of wet snow, freezing fog, or freezing rain on the outside cover of the antenna, column 2, lines 10-16, 21-30, and 53-55. Walton, Jr. teaches using a spring cable and turnbuckle type assembly for retaining the cover to the dish periphery being similar to Franklin '253 and '972 that relies upon a symmetrically round dish periphery to draw the cover tight in a drum skin like fashion across the concave portion of the dish, wherein a non-symmetrical dish periphery would not allow this draw-cord pulling tension system to work properly in stretching the cover across the concave portion of the dish. Another prior art example for a symmetric dish cover is in U.S. Pat. No. 5,729,241 to Ergen et al. that discloses a cover having a rigid "J" clip positioned on the outside periphery of the cover that removably engages the margin outer rim of the satellite dish with the added feature of cover adjustability for stretching the spanned drum skin segment of the cover over the concave portion of the dish. Ergen et al., also requires that the dish have a symmetric outer periphery for proper stretching of the cover to occur during installation of the cover by needing even dish periphery attachment tension from a plurality of "J" strips, see column 7, lines 56-67.

What is needed is a satellite dish cover that can accommodate non-symmetrical dish shapes especially related to a non-symmetric outer periphery, wherein the disclosed prior art substantially relies upon a symmetric outer periphery for the dish to typically enable a single tensioning element to evenly pull the cover over the symmetric outer periphery to desirably tension the cover for a drum skin like span over the concave portion of the dish. This stretching is important for the cover over the concave portion of the dish for a number of reasons, firstly to help deflect the snow and freezing rain from the cover itself, because if the cover was not stretched tight the snow and freezing rain could more easily accumulate. Furthermore, if the cover is sagging it may undesirably reflect solar rays onto the horn potentially causing horn component damage, also if the cover is loose; it will not add any structural strength to the dish as opposed to if the cover were tightly stretched over the concave portion of the dish. However, getting the cover to tightly stretch over the concave portion of the non-symmetrical dish with the non-symmetrical outer periphery practically eliminates the use of a single tensioning element, that if used in the conventional manner would result in uneven stretching of the cover over the concave portion of the dish due to the larger outer periphery areas being stretched more that the smaller outer periphery areas of the non-symmetric dish resulting in an undesirable sagging dish cover for the reasons previously given.

Thus, for a new satellite dish cover to desirably stretch in a taut manner spanning across the concave portion of an non-symmetric dish, as currently used by HDTV, would require a plurality of tensioning elements that are positioned to cause an even stretching of the cover over a non-even outer periphery creating a highly segmented cover tensioning element structure.

SUMMARY OF INVENTION

Broadly, the present invention of the receiver cover is to partially envelope a receiver, with the receiver having a non-symmetrical outer edge portion, the receiver cover including a flexible panel having a peripheral margin portion with the peripheral margin portion being adjacent to the receiver non-symmetrical outer edge portion. The receiver cover also including structure for removably engaging the panel to the non-symmetrical outer edge portion of the receiver.

These and other objects of the present invention will become more readily appreciated and understood from a consideration of the following detailed description of the exemplary embodiment(s) of the present invention when taken together with the accompanying drawings, in which;

REFERENCE NUMBERS IN DRAWINGS

Figure 1:
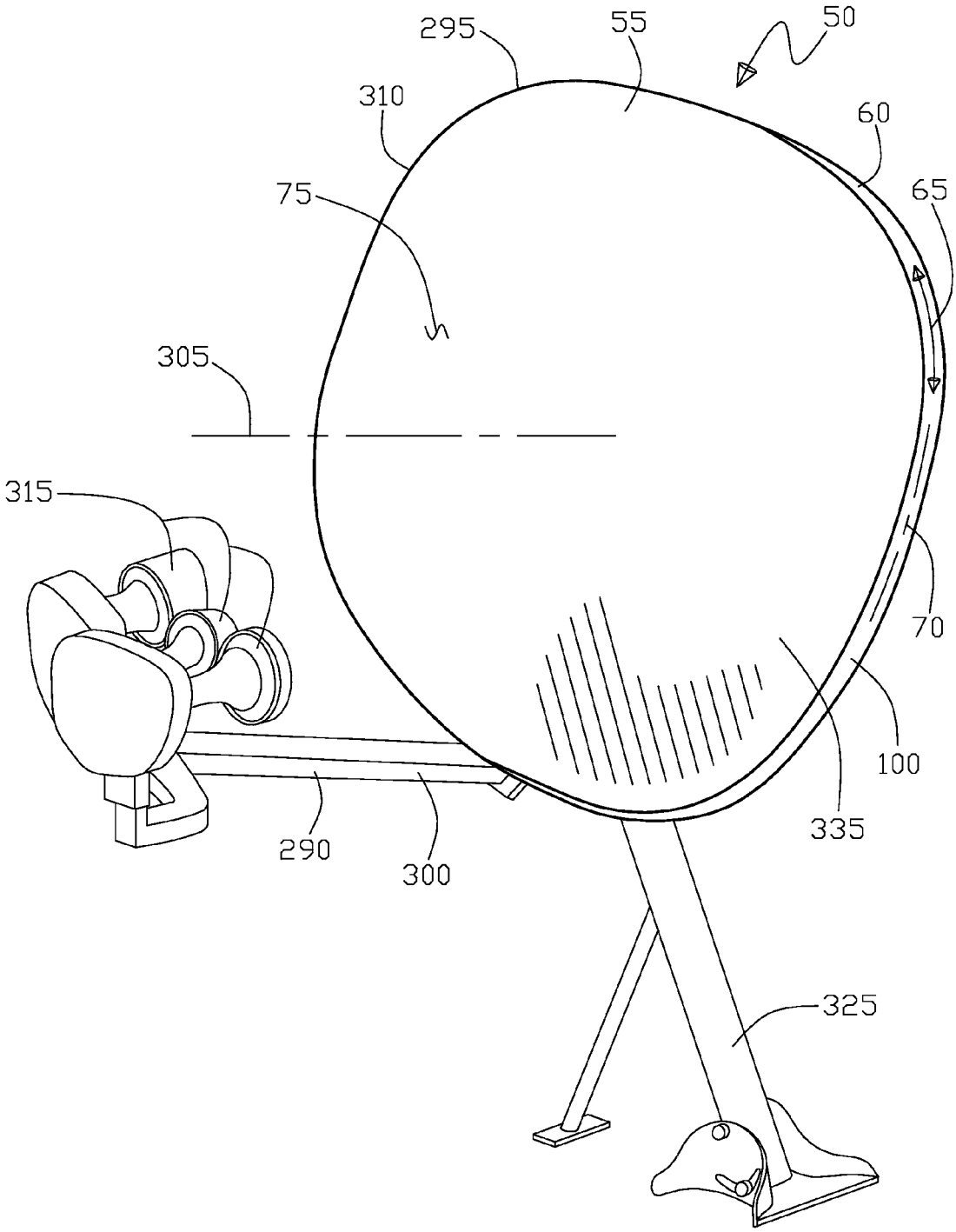
FIG. 1 shows a perspective view of the receiving side of the receiver with the cover in use installed with the three receiver horns that receive signals from the non-symmetrical dish having a non-symmetrical outer edge portion along with the support base for the receiver.

50 Cover for the receiver 290
55 Flexible panel
60 Peripheral margin portion of the flexible panel 55
65 Tangential border of the peripheral margin portion 60
70 Tangential axis of the peripheral margin portion 60
75 Substantially planar profile of the flexible panel 55
80 Adjacent positioning or blanketing of the peripheral margin portion 60 of the flexible panel 55 to the non-symmetrical outer edge portion 295 of the receiver 290
85 Partially enveloping of the receiver 290 by the receiver cover 50
90 Perpendicular positioning of the lengthwise axis 190 to the tangential border 65
95 Co-incident relationship of the tangential border 65 relative to the tangential axis 70
100 Termination of the peripheral margin portion 60
105 Cantilevering of the peripheral margin portion 60 termination 100 from the non-symmetrical outer edge portion 295 of the receiver 290
110 Hem that is single inwardly folded at the termination 100
115 First side of hem portion 110
120 Adjacent positioning of hem first side 115 to the receiver 290
125 Second side of hem 110
130 Fold portion of the hem 110
155 Stretching of the panel 55
160 Aperture disposed therethrough the hem 110
170 Grommet disposed within each aperture 160
175 Disposing of each the aperture grommets 170 therethrough the hem 110
180 Means for removably engaging the panel 55 to the non-symmetrical outer edge portion 295
185 Tension element
190 Lengthwise axis of the tension element 185
195 Lengthwise axis of the tension element 185 spanning therebetween the proximal end portion 200 and the distal end portion 205
200 Proximal end portion of the tension element 185
205 Distal end portion of the tension element 185
210 Disposing of the distal end portion 205 therethrough the aperture 160
215 Adjacent positioning of the lengthwise axis 190 to the peripheral margin portion 60
220 Adjacent positional relationship of grommet 170 to the tension element 185
225 Therethrough positioning of the tension element 185 within the grommet 170
230 Tensile force along the lengthwise axis 190
235 Moment about the tangential axis 70 from the tensile force 230
240 Concentrating of the moment 235 as against the second side 125 of the hem 110
245 Positioning of tension element 185 about the peripheral margin portion 60
260 Acute angle between each adjoining lengthwise axis 190
275 Positioning of the proximal end portion 200 to intersect the axial axis 305 wherein the lengthwise axis 190 or 195 is substantially perpendicular to the tangential axis 70
280 Extending radially outward of each of the plurality of tension elements 185 from the axial axis 305 to the hem 110

290 Receiver
295 Non-symmetrical outer edge portion of the receiver 290
300 Satellite dish receiver
305 Axial axis of the satellite dish receiver 300
310 Non-symmetrical outer edge portion of the satellite receiver 300
315 Receiver horns
320 Receiver dish that is non-symmetrical
325 Support base structure for the receiver 290 or 300
330 Building structure
335 Receiving side of the receiver 290 or 300
340 Non-receiving side of the receiver 290 or 300
345 Placing the panel 55 over the dish 300 opposite of the support structure 325
350 Positioning the panel 55 in relation to the dish 300
355 First selected aperture
356 Second selected aperture
357 Third selected aperture
358 Forth selected aperture
359 Fifth selected aperture
360 First selected tension element
361 Second selected tension element
362 Third selected tension element
365 Attaching therethrough the first selected aperture 355 a first selected tension element 360
375 Forming a "V" openly facing the support structure 325
380 Securing distal end portions 205 of the first selected tension element 360 and the second selected tension element 361 to the second 356 and third 357 selected apertures respectively
385 Securing a proximal end portion 200 and a distal end portion 205 of the second selected tension element 361 to the fourth 358 and fifth 359 selected apertures respectively
390 Correspondingly oppositely disposed apertures 160
395 Coin

DETAILED DESCRIPTION

Figure 2:
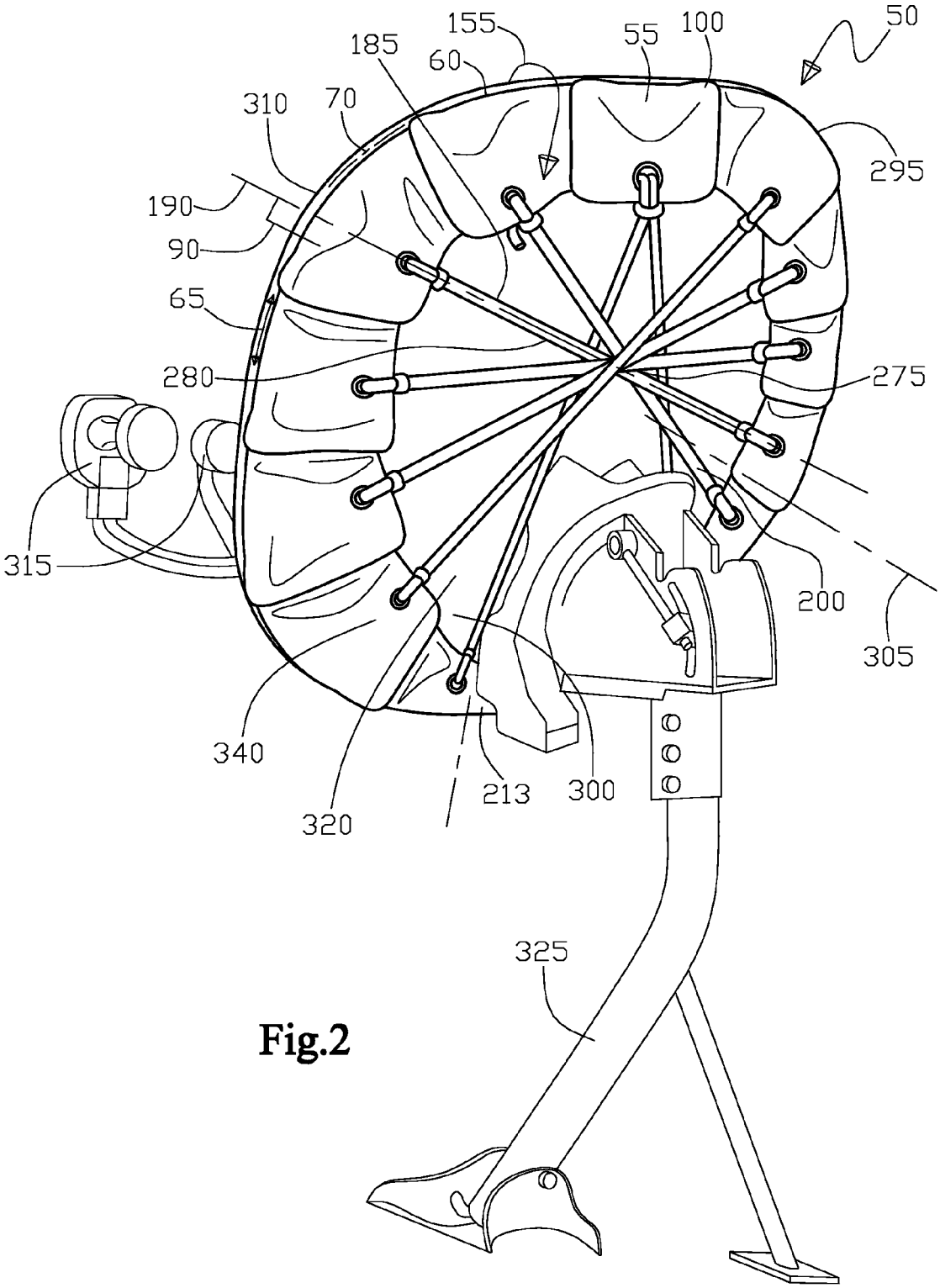
FIG. 2 shows a perspective view of the non-receiving side of the receiver with the cover in use installed with the support base of the non-symmetrical dish having a non-symmetrical outer edge portion.
Figure 3:
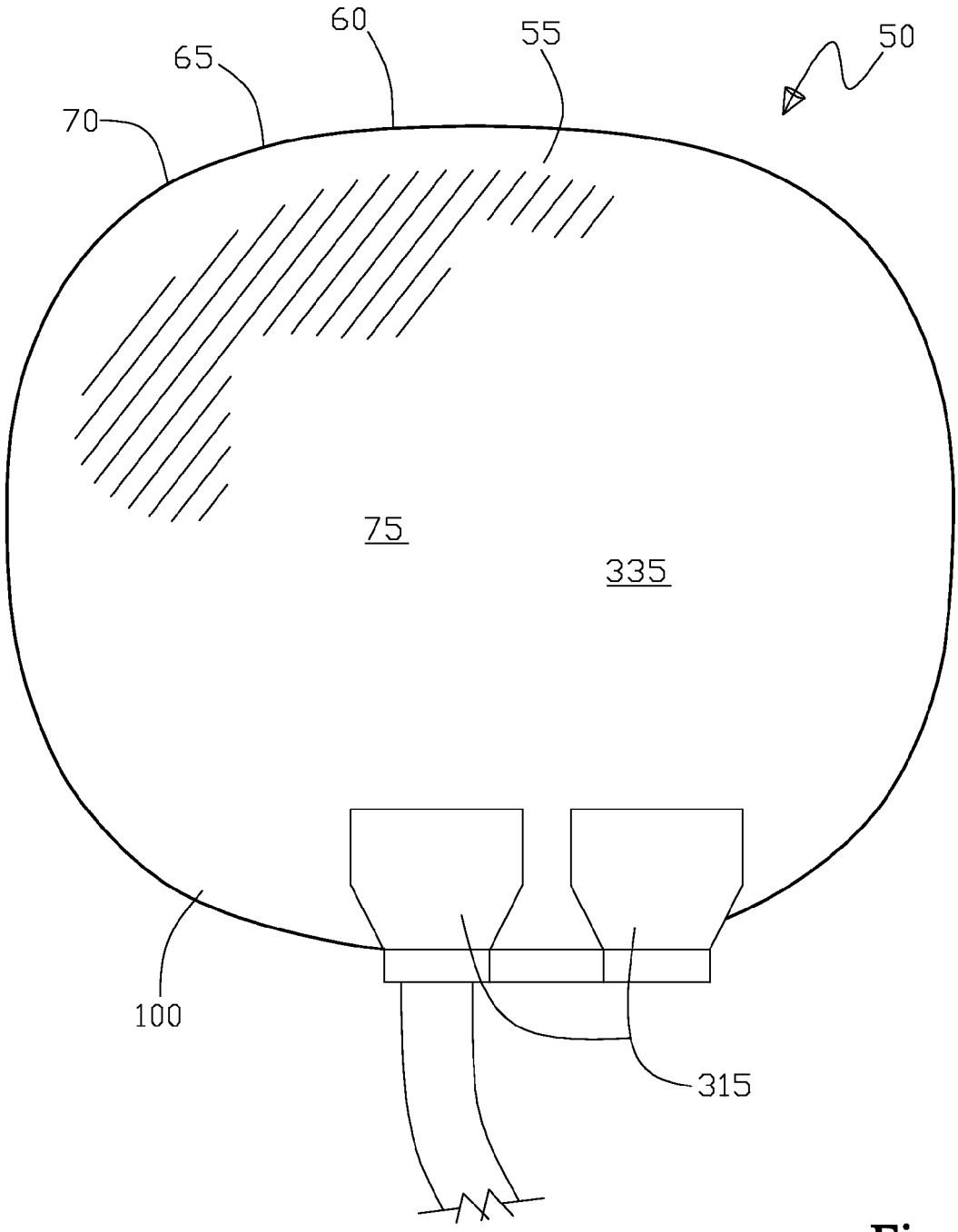
FIG. 3 shows an elevation view of the receiving side of the receiver with the cover in use installed with the three receiver horns that receive signals from the non-symmetrical dish having a non-symmetrical outer edge portion.
Figure 4:
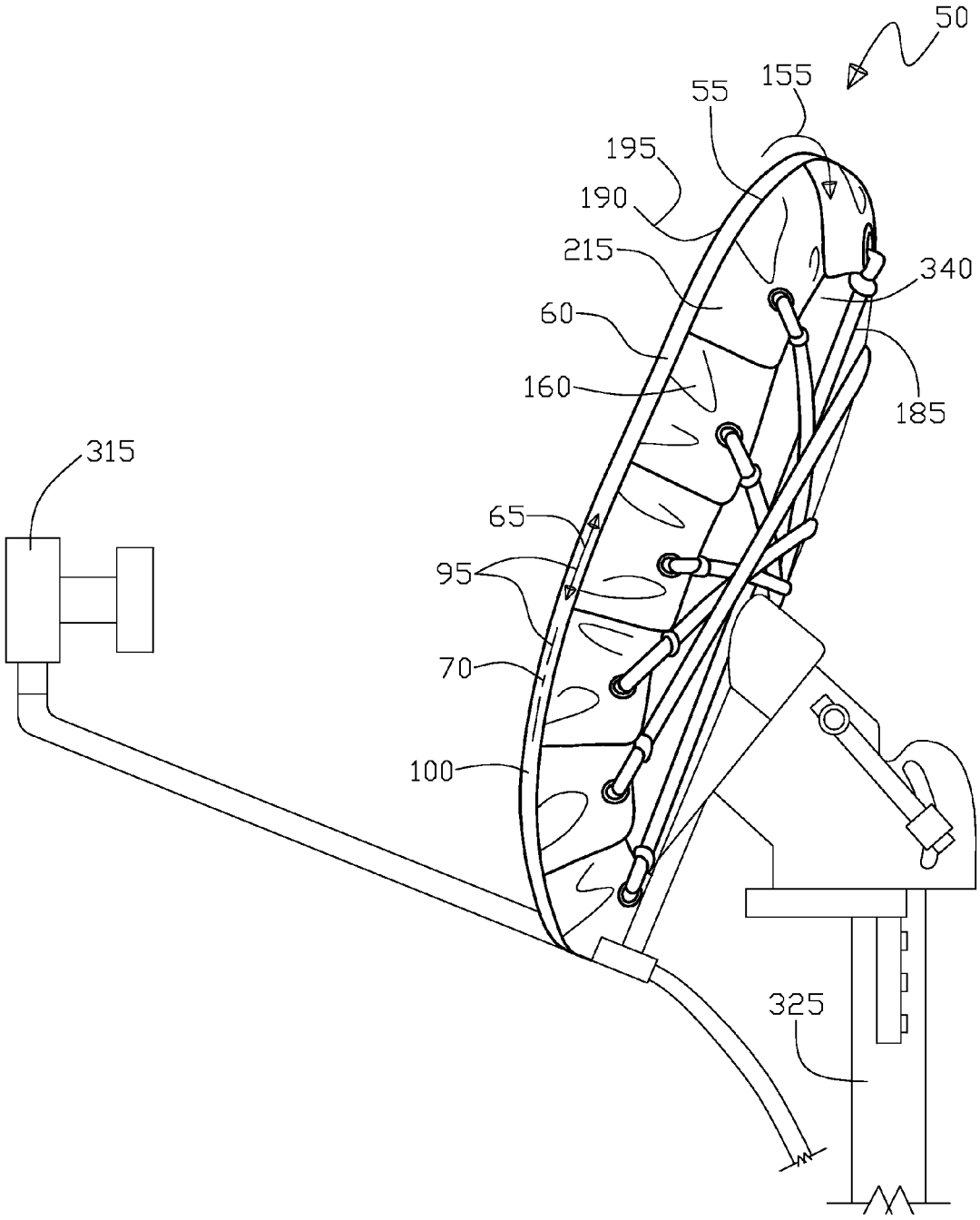
FIG. 4 shows a side elevation view of the receiver with the cover in use installed with the three receiver horns that receive signals from the non-symmetrical dish having a non-symmetrical outer edge portion along with the support base for the receiver.

With initial reference to FIG. 1 shown is a perspective view of the receiving side 335 of the receiver 290 with the cover 50 in use installed with the three receiver horns 315 that receive signals from the non-symmetrical dish 320 having a non-symmetrical outer edge portion 310 along with the support base 325 for the receiver 290. Continuing, FIG. 2 shows a perspective view of the non-receiving side 340 of the receiver 290 with the cover 50 in use installed with the support base 325 of the non-symmetrical dish 320 having a non-symmetrical outer edge portion 310. Next, FIG. 3 shows an elevation view of the receiving side 335 of the receiver 290 with the cover 50 in use installed with the three receiver horns 315 that receive signals from the non-symmetrical dish 320 having a non-symmetrical outer edge portion 310. Further, FIG. 4 shows a side elevation view of the receiver 290 with the cover 50 in use installed with the three receiver horns 315 that receive signals from the non-symmetrical dish 320 having a non-symmetrical outer edge portion 310 along with the support base 325 for the receiver 290.

Figure 5:
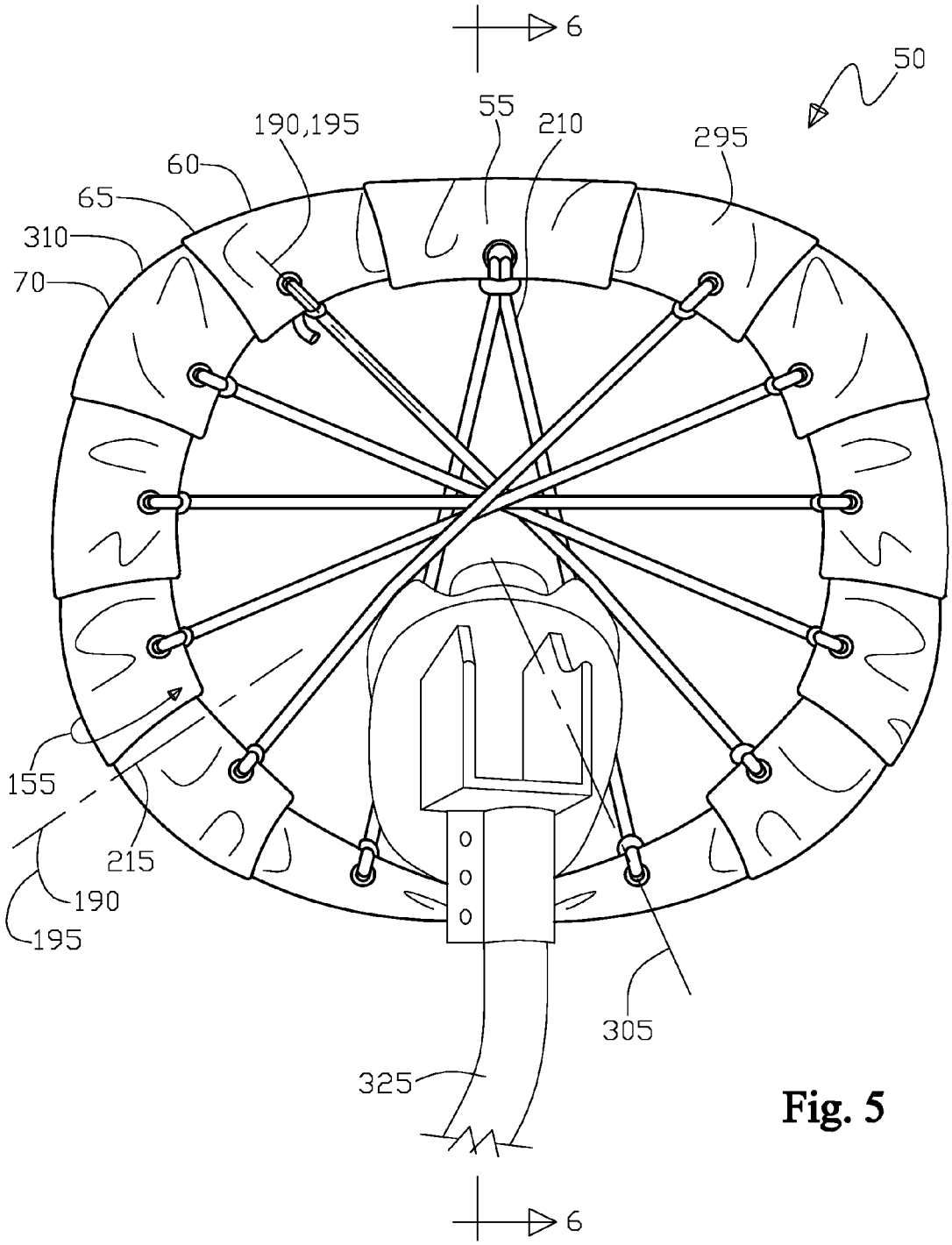
FIG. 5 shows an elevation view of the non-receiving side of the receiver with the cover in use installed with the support base of the non-symmetrical dish having a non-symmetrical outer edge portion.
Figure 6:
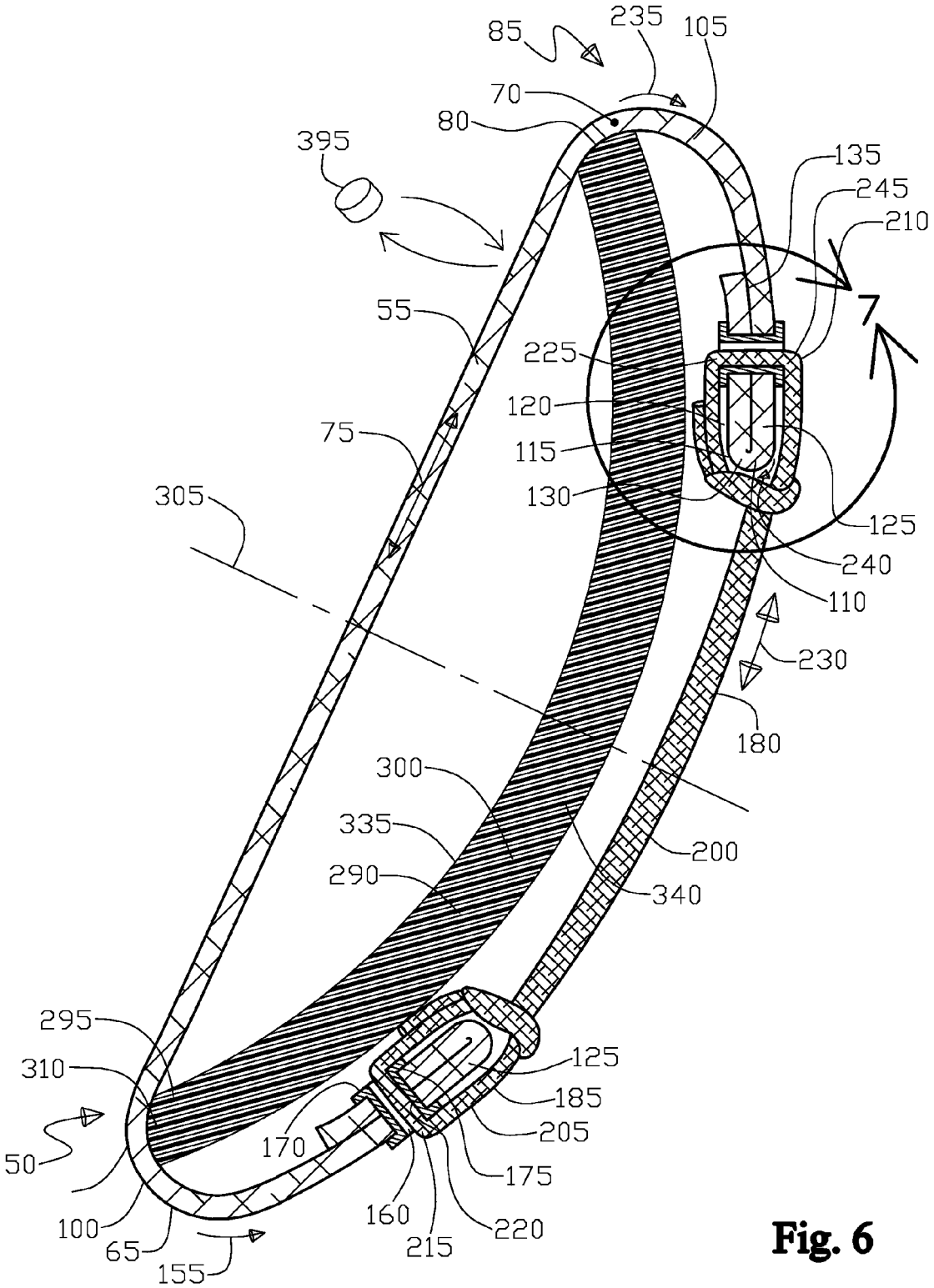
FIG. 6 shows cross sectional view 6-6 from FIG. 5 with the assembled in use components of the cover and tension elements, blanketed over the non-symmetrical dish with the horns and support base removed for pictorial clarity.

Moving onward, FIG. 5 shows an elevation view of the non-receiving side 340 of the receiver 290 with the cover 50 in use installed with the support base 325 of the non-symmetrical dish 320 having a non-symmetrical outer edge portion 310 and FIG. 6 shows cross sectional view 6-6 from FIG. 5 with the assembled in use components of the cover 50 and tension elements 185, being blanketed 80 over the non-symmetrical dish 320 with the horns 315 and support base 352 removed for pictorial clarity. Yet further, FIG. 7 shows expanded view 7 from FIG. 6 with the assembled in use components of the cover 50 and tension elements 185, adding greater detail on the cover 50 hem 110, apertures 160, and aperture 160 grommet 170 with the cover 50 blanketed 80 over the non-symmetrical dish 320 again with the horns 315 and support base 325 removed for pictorial clarity.

Figure 8:
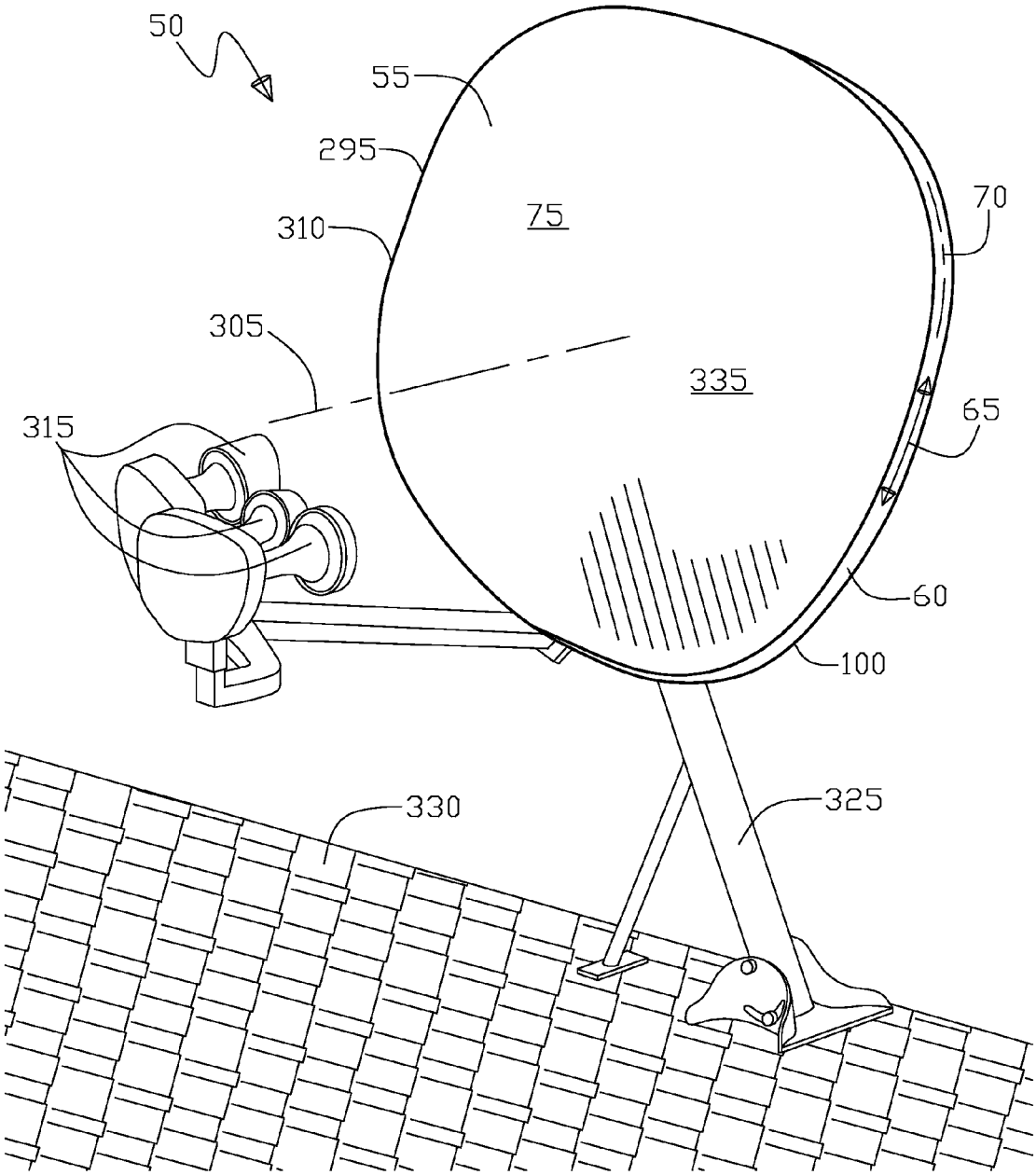
FIG. 8 shows a perspective view of the receiving side of the receiver with the cover in use installed with the three receiver horns that receive signals from the non-symmetrical dish having a non-symmetrical outer edge portion along with the support base for the receiver that is adjacent to a support structure.
Figure 9:
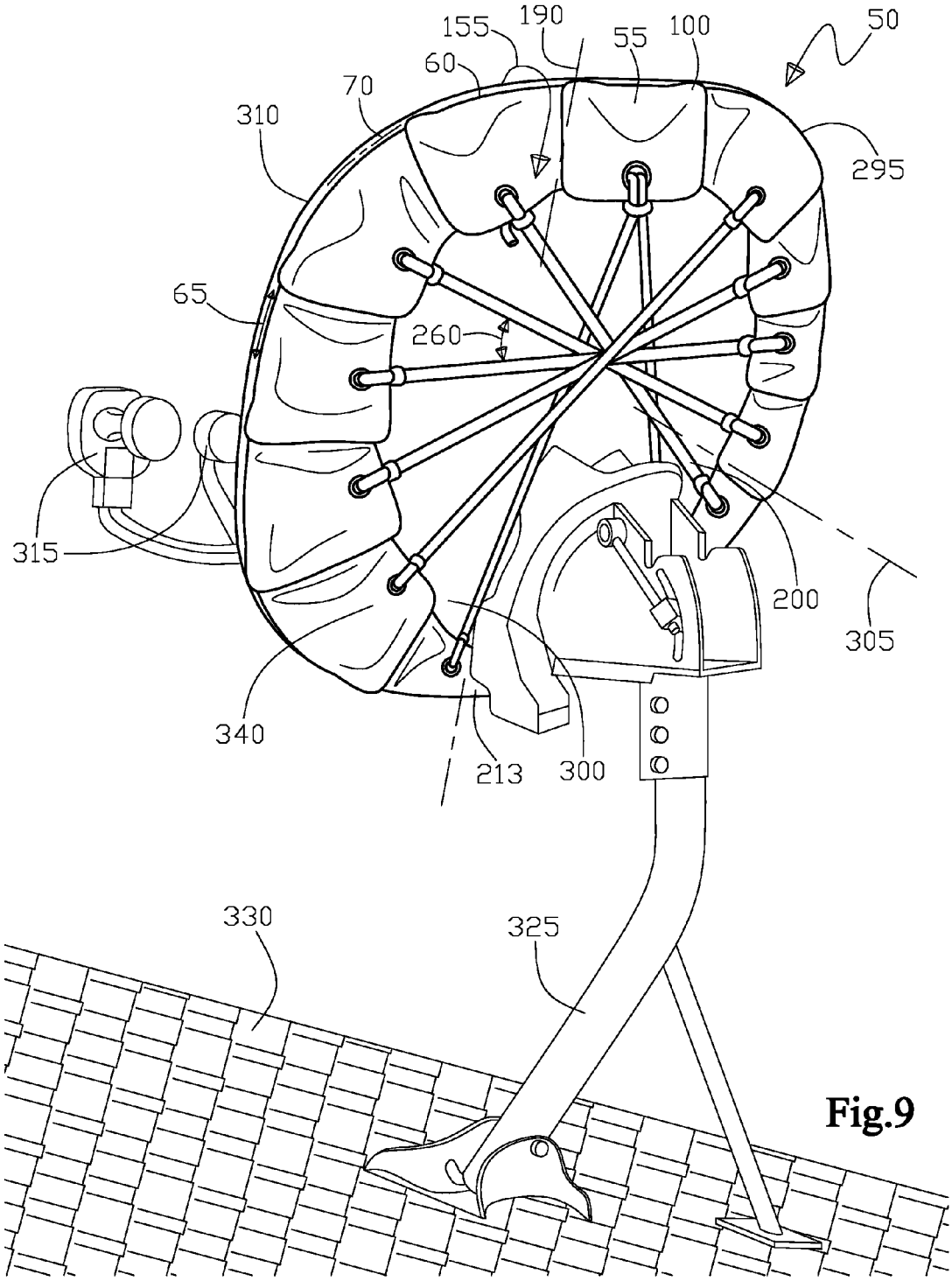
FIG. 9 shows a perspective view of the non-receiving side of the receiver with the cover in use installed with the support base of the non-symmetrical dish having a non-symmetrical outer edge portion, wherein the support base is adjacent to the support structure.
Figure 10:
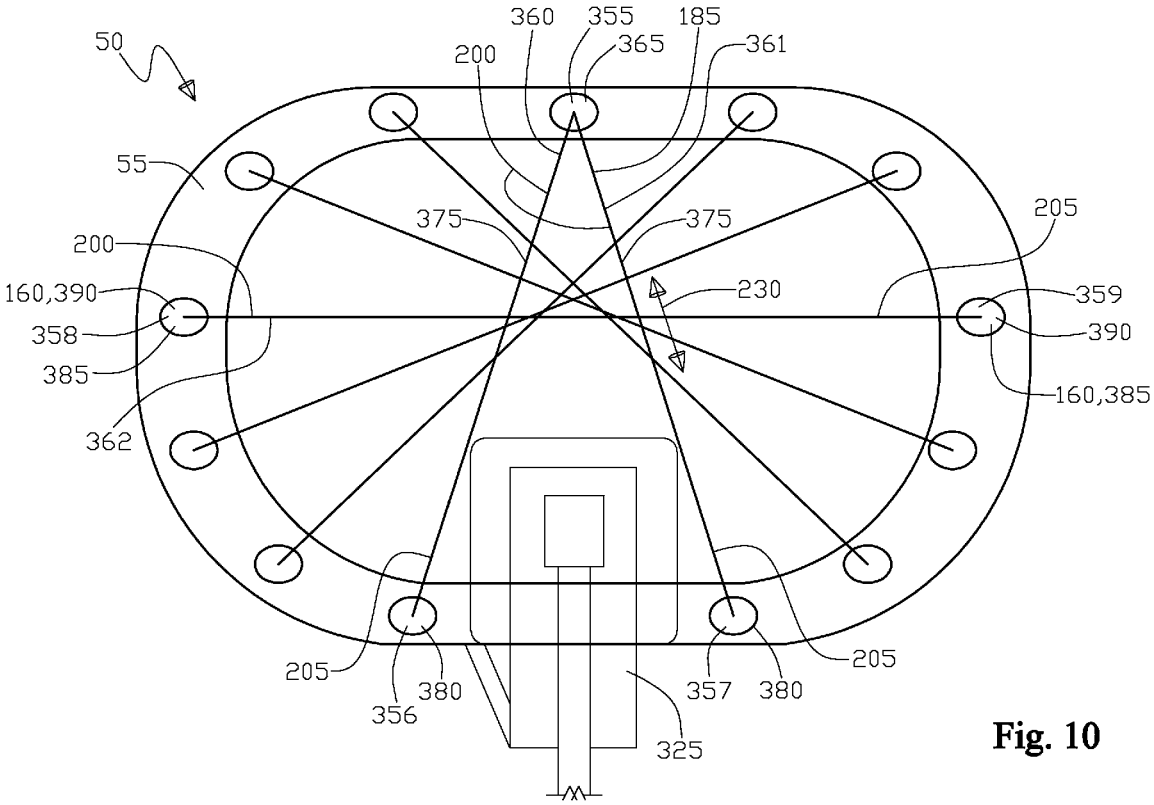
FIG. 10 shows an elevation schematic type view of the non-receiving side of the receiver with the cover in use installed with the support base of the non-symmetrical dish having a non-symmetrical outer edge portion.
Figure 11:
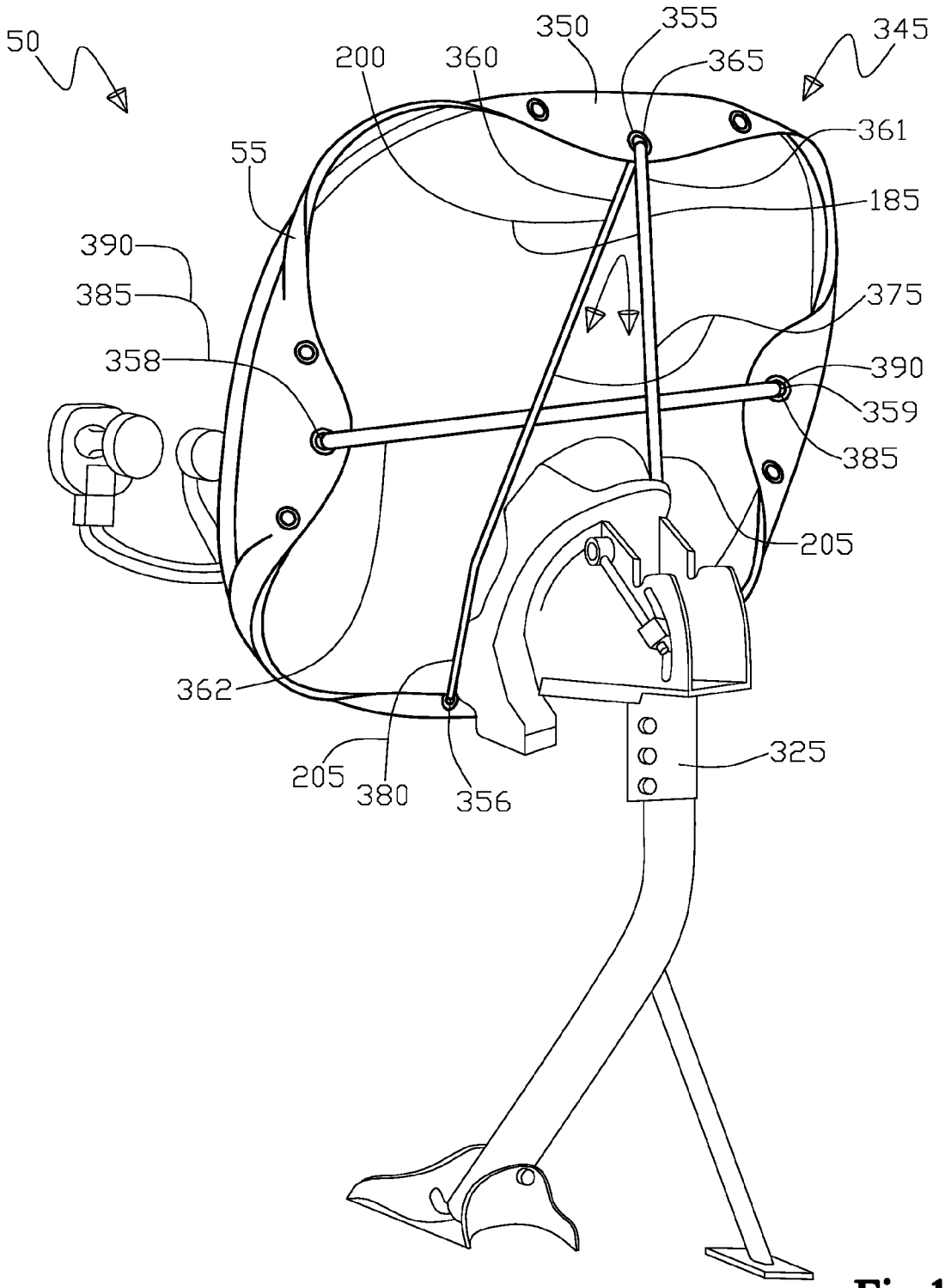
FIG. 11 shows a perspective view of the non-receiving side of the receiver with the cover in use installed with the support base of the non-symmetrical dish having a non-symmetrical outer edge portion, with the first selected tension element and the second selected tension element shown.

Next, FIG. 8 shows a perspective view of the receiving side 335 of the receiver 290 with the cover 50 in use installed with the three receiver horns 315 that receive signals from the non-symmetrical dish 320 having a non-symmetrical outer edge portion 310 along with the support base 325 for the receiver 290 that is adjacent to the support structure 330. Continuing, FIG. 9 shows a perspective view of the non-receiving side 340 of the receiver 290 with the cover 50 in use installed with the support base 325 of the non-symmetrical dish 320 having a non-symmetrical outer edge portion 310, wherein the support base 325 is adjacent to the support structure 330. Further, FIG. 10 shows an elevation schematic type view of the non-receiving 340 side of the receiver 300 with the cover 50 in use installed with the support base 325 of the non-symmetrical receiver dish 300 having a non-symmetrical outer edge portion 310. Moving onward, FIG. 11 shows a perspective view of the non-receiving side 340 of the receiver 300 with the cover 50 in use installed with the support base 325 of the non-symmetrical receiver dish 300 having a non-symmetrical outer edge portion 310, with the first selected tension element 360 and the second selected tension element 361 shown.

Broadly in referring primarily to FIGS. 1 through 7, the present invention of a receiver cover 50 is to partially envelope 85 the receiver 290, with the receiver 290 having a non-symmetrical outer edge portion 295. The receiver cover 50 includes a flexible panel 55 having a peripheral margin portion 60, with the peripheral margin portion 60 being adjacent to the receiver 290 non-symmetrical outer edge portion 295 and a means 180 for removably engaging the panel 55 to the non-symmetrical outer edge portion 295. Further, on the means 180 for removably engaging, preferably utilizes a tensioning element 185 as best shown in FIGS. 2, 4, 5, 7, and 9, wherein the tensioning element 185 has a lengthwise axis 190 that is adjacent 215 to the peripheral margin portion 60 of the panel 55, and furthermore preferably the tensioning element 185 is also positioned 245 about the peripheral margin portion 60 and is substantially perpendicular 90 along the lengthwise axis 190 relative to a tangential border 65 that is co-incident 95 with a tangential axis 70 of the peripheral margin portion 60 as best shown in FIG. 5 and to some degree in FIG. 2. Also preferably the means 180 for removably engaging can optionally include an aperture 160 disposed in the peripheral margin portion 60, wherein the tensioning element 185 is disposed 210 therethrough the aperture 160 as best shown in FIGS. 2, and 4 through 7.

Figure 7:
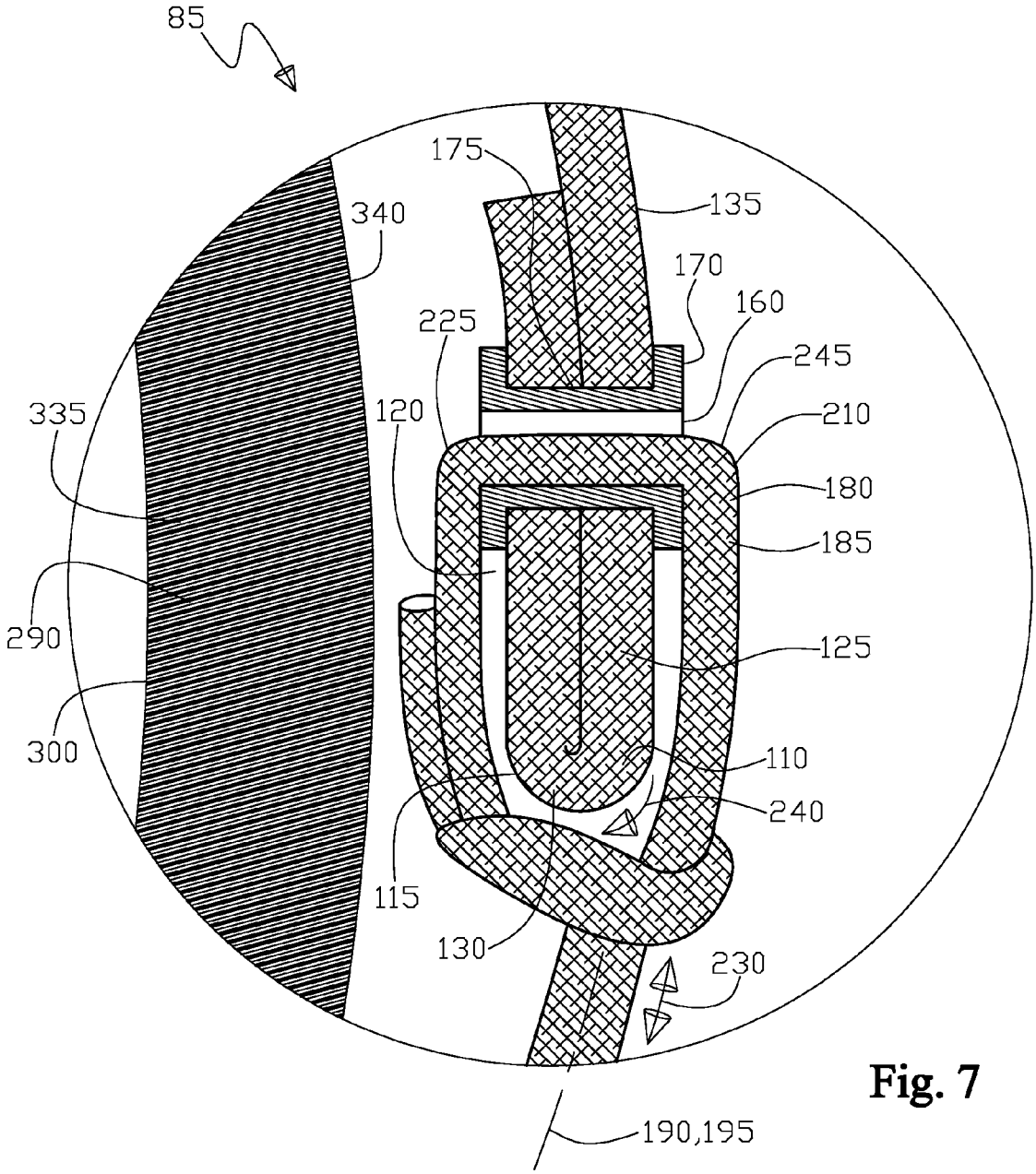
FIG. 7 shows expanded view 7 from FIG. 6 with the assembled in use components of the cover and tension elements, adding greater detail on the cover hem portion, apertures, reinforcement component, and the aperture grommet with the cover blanketed over the non-symmetrical dish again with the horns and support base removed for pictorial clarity.

As an enhancing option, to the means 180 for removably engaging, a grommet 170 that is preferably adjacent 220 to the tensioning element 185 and the peripheral margin portion 60 is mounted as best shown in FIGS. 6 and 7. The grommet 170 is operational to facilitate a moment 235 about the tangential axis 70 from a tensile force 230 along the lengthwise axis 190, see FIGS. 6 and 7, that is operational to help stretch the panel 55 into a desirably planar profile 75, see FIG. 6, to capture the non-symmetrical outer edge portion 295 thereby partially enveloping 85 or blanketing 80 the receiver with cover 50. Preferably, the tensile force 230, is in the range of about three (3) to four (4) pounds force, wherein the force along the lengthwise axis 190 can be variable to pull the slack from the hem 110, however, tensile force 230 can be higher or lower than the specified range as strength levels in the tension element 185 and aperture 160 dictate. As a continuing further refinement of the means 180 for removably engaging the aforementioned tension element 185 is comprised of a plurality of tensioning elements 185 and apertures 160 that are each positioned about the peripheral margin portion 60, as best shown in FIGS. 2, 4, and 5, wherein each individual tensioning element 185 is capable of a different tensile force 230 that further accommodates the cover 50 panel 55 maintaining a substantially planar profile 75 to envelope 85 the receiver 290 having the non-symmetrical outer edge portion 295.

Continuing on the plurality of tension elements 185 of the means 180 for removably engaging, wherein the plurality of tensioning elements 185 that each have the lengthwise axis 190 are preferably positioned such that each the adjoining lengthwise axis 190 forms an acute angle 260 relative to one another in the manner of an asterisk style originating from the axis 305 to the peripheral margin portion 60, as best shown in FIGS. 2 and 5, to better accommodate the receiver 290 non-symmetrical outer edge portion 295 to have the cover 50 panel 55 maintain a substantially planar profile 75 to envelope the receiver 290 as desired. Further, on the plurality of tension elements 185 of the means 180 for removably engaging, wherein the plurality of tensioning elements 185 that each have the lengthwise axis 190 are positioned such that each adjoining lengthwise axis 190 forms an acute angle 260 relative to one another in the manner of an asterisk style originating from the axis 305 to the peripheral margin portion 60, see again FIGS. 2 and 5, also to better accommodate the receiver 290 non-symmetrical outer edge portion 295 to have the cover 50 panel 55 maintain a substantially planar profile 75 of the flexible panel 55 to partially envelope 85 the receiver 290.

Yet, further on the plurality of tension elements 185 of the means 180 for removably engaging another preferable option is to include a plurality of aperture 160 grommets 170 disposed 175 within the peripheral margin portion 60, wherein each tensioning element 185 is placed therethrough 225 each grommet 170, as best shown in FIGS. 6 and 7. The preferred materials of construction for the grommet 170 are primarily brass, or alternatively polypropylene, or any other materials that are weatherproof and at least match the strength requirements of the hem 110 and the tension element 185. The general preferred materials of construction the plurality of tensioning elements 185 are constructed of materials selected from the group consisting essentially of rope, cable, elastic bands, or straps. Specifically, the preferred materials of construction for the tensioning element 185 is of an elastomeric material, or more specifically Nylon rope that has been treated with Ultra Violet (UV) resistant protection or alternatively synthetic rope that has mixed fibers, such as polyester and/or polypropylene also that are UV treated, or any other materials that are weatherproof and that are at least matching in strength to the hem 110 or grommet 170.

Returning to the cover 50 or more specifically the panel 55, the peripheral margin portion 60 is preferably formed from a single inwardly folded wide hem 110 that has a first side 115 that is adjacent 120 to the receiver 290 and an opposing second side 125, see FIGS. 6 and 7 for detail. Furthermore, the aperture 160 grommets 170 are disposed therethrough the hem 110 and the grommet 170 operational to further create the moment 235 from the tensioning element 185 tensile force 230 that is concentrated 240 as against the second side 125 of the hem 110 that ultimately results in the desired planar profile 75 of the panel 55 stretching across the receiving side 335 of the receiver 290.

Continuing in more detail and again in referring to FIGS. 1 through 7, the cover 50 being for the satellite dish receiver 300, wherein the receiver has an axial axis 305, with the receiver 300 having a non-symmetrical outer edge portion 310. The cover 50 includes the flexible panel 55 having a peripheral margin portion 60, wherein the peripheral margin portion 60 blankets 80 the non-symmetrical outer edge portion 310 of the receiver 300, wherein the peripheral margin portion 60 terminates 100 in a single inwardly folded wide hem 110 that has a plurality of apertures 160 disposed therethrough said hem 110. The peripheral margin portion 60 termination 100 is substantially cantilevered 105 form the non-symmetrical outer edge portion 310 of the receiver 300, wherein the termination 100 is adjacent to a tangential border 65 that is co-incident 95 with a tangential axis 70 of the peripheral margin portion 60.

Further included in the cover 50 panel 55, in looking specifically at FIGS. 2, and 4 through 7, are the plurality of tension elements 185, each one having a terminal proximal end portion 200 and a terminal distal end portion 205 with a lengthwise axis 195 spanning therebetween. Each one of the tension elements 185 is disposed 210 at the distal end portion 205 and the proximal end portion 200 therethrough being independently removably engagable to each one of oppositely disposed pairs of the plurality of apertures 160 and each proximal end portion 200 is adjacent to the axial axis 305 such that each lengthwise axis 195 is substantially perpendicular 275 to the tangential axis 70, resulting in the plurality of tension elements 185 extending radially outward 280 in originating from the axial axis 305 to the hem 110. Operationally, the plurality of tension elements 185 each act to impart an independent tensile force 230 upon the hem 110 to further maintain a substantially planar shape 75 of the panel 55 within the non-symmetrical outer edge portion 310 of the receiver 300 on the receiving side 335 of the receiver. Thus the tension elements 185 are formed from a plurality of tension elements 185 that are separate and independent from one another, resulting in a particular tension element 185 having its own unique tensile force 230 that does not influence any other one of the other plurality of tension elements 185, thus being differentiated from shoe laces for example that form a continuous tension element that threads through a plurality of apertures, wherein the tensile force affects throughout the plurality of apertures from the single long tension element.

As additional option for the cover 50 panel 55, in looking in particular at FIGS. 6 and 7, the cover panel 55 can further comprise a plurality of aperture 160 grommets 170 that are each disposed within each one the apertures 160, wherein each one of the tension elements 185 is disposed therethrough each one of the grommets 170. The preferred material of construction for the cover 50 panel 55 are Nylon, GORE-TEX, CTX cloth, SUNBRELLA, or any alternative materials that are a substantially weatherproof material having sufficient strength for the cumulative tensile force 230 of the tension elements 185 to help secure the panel 55 to the receiver dish 300. Continuing, on the apertures 160, they are preferably symmetrically spaced apart from one another along the tangential border 65, as best shown in FIGS. 2 and 5, wherein this symmetric spacing being operational to apply each of the tensile forces from each tensile element 185 to the peripheral margin portion 60 to further maintain a substantially planar shape 75 of the panel 55 within the non-symmetrical outer edge portion 310 of the receiver 300 by uneven stretching 155 of the panel 55 that results in the substantially planar profile 75 that is desired. Note that the application of tensile force 230 coupled with the symmetric spacing act to stretch the panel 55 in non-symmetrical directions and forces to help accommodate the non-symmetrical outer edge portion 310 of the receiver 300 in achieving the desired substantially planar 75 panel 55 as stretched across the receiving side 335 of the receiver 300.

METHOD OF USE

Referring in particular to FIGS. 1 through 11 and in particular to FIGS. 10 and 11, a method of installing a cover 50 is disclosed for a satellite dish receiver 300 having an axial axis 305 and a support base or support base structure 325 with the receiver 300 having a non-symmetrical outer edge portion 310. Starting with a first step of providing a cover 50 as previously described and next a step of placing 345 the panel 55 over the receiver dish 300 opposite of the support base structure 325, as best shown in FIGS. 1, 2, 4, 5, 6, 7, 10 and 11. A further step of positioning 350 the panel 55 in relation to the receiver dish 300 such that a first selected aperture 355 in the panel 55 is positioned opposite of and facing the support base structure 325, wherein the first selected aperture 355 is adjacent to the receiver dish 300 outer edge portion 310, as best shown in FIGS. 10 and 11. Continuing, a next step is in attaching 365 therethrough the first selected aperture 355 a first selected tension element 360, again as best shown in FIGS. 10 and 11 then a positioning step of the first selected tension element 360 lengthwise axis 195 to form one half of a "V" 375 openly facing the support base structure 325, or as appropriate the open portion of the "V" 375 facing the source of gravity for initially securing the cover 50 to the receiver dish 300, also as best shown in FIGS. 10 and 11. Next, a step of attaching therethrough the first selected aperture 355 a second selected tension element 361 and then a step of positioning the second selected tension element 361 along the lengthwise axis 195 to form a remaining half of said "V" openly facing the support structure 325.

Continuing, a step of securing the distal end portions 205 of the first selected tension element 360 and the second selected tension element 361 to a second selected aperture 356 and a third selected aperture 357 respectively, again as shown in FIGS. 10 and 11. Further an optional step of securing 385 a proximal end portion 200 and a distal end portion 205 of a third selected tension element 362 to a fourth selected aperture 358 and a fifth selected aperture 359 respectively, wherein the securing can be done by any method suitable for being weatherproof and able to withstand the previously mentioned tensile force 230, such as knotting, latching, and the like. Further, an option of further comprising a step of adding the plurality of tension elements 185 such that the distal end portions 200 are each secured to an aperture 160 and that the plurality of proximal end portions 205 are each secured to a corresponding oppositely disposed aperture 390 for each of the plurality of tension elements 185, as best shown in FIG. 10. Yet another optional step is of independently adjusting each of the tensile forces 230 of each of the plurality of tension elements 185 such that a coin 395 will bounce off of the panel 55 on the receiving side 335 of the receiver dish 300, as best shown in FIGS. 1 and 10.

CONCLUSION

Accordingly, the present invention of a receiver cover 50 has been described with some degree of particularity directed to the embodiment(s) of the present invention. It should be appreciated, though; that the present invention is defined by the following claims construed in light of the prior art so modifications or changes may be made to the exemplary embodiment(s) of the present invention without departing from the inventive concepts contained therein.

The invention claimed is:

1. A cover for a satellite dish receiver having an axial axis, with the receiver having a non-symmetrical outer edge portion, said cover comprising:
   (a) a flexible panel having a peripheral margin portion, said peripheral margin portion blankets the non-symmetrical outer edge portion of the receiver, wherein said peripheral margin portion terminates in a single inwardly folded wide hem having a plurality of apertures disposed therethrough said hem, said peripheral margin portion termination is cantilevered from the non-symmetrical outer edge portion of the receiver, wherein said termination is adjacent to a tangential border that is co-incident with a tangential axis of said peripheral margin portion; and
   (b) a plurality of separate and independent tension elements, each said tension element having a terminal proximal end portion and a terminal distal end portion with a lengthwise axis spanning therebetween, each one of said plurality of tension elements has said distal end portion being independently removably engaged to a single aperture and has said proximal end portion being independently removably engaged to an oppositely disposed single aperture, each said tension element is adjacent to said axial axis such that each said lengthwise axis is perpendicular to said tangential axis, resulting in said plurality of tension elements extending radially outward in originating from said axial axis to said hem, operationally said plurality of tension elements each act to impart a completely independent tensile force upon said hem to further maintain a planar shape of said panel within the non-symmetrical outer edge portion of the receiver.

2. A cover for a satellite dish receiver according to claim 1 further comprising a plurality of aperture grommets each disposed within each one said apertures, wherein each one of said plurality of tension elements is disposed therethrough each one of said grommets.

3. A cover for a satellite dish receiver according to claim 1 wherein said plurality of tensioning elements are constructed of materials selected from the group consisting essentially of rope, cable, elastic bands, or straps.

4. A cover for a satellite dish receiver according to claim 1 wherein said panel is constructed of a substantially weatherproof material.

5. A method of installing a cover for a satellite dish receiver having an axial axis and a support structure with the receiver having a non-symmetrical outer edge portion, comprising the steps of:
   (a) providing said cover that includes a flexible panel having a peripheral margin portion, said peripheral margin portion blankets the non-symmetrical outer edge portion of the receiver, wherein said peripheral margin portion terminates in a single inwardly folded wide hem having a plurality of apertures disposed therethrough said hem, said peripheral margin portion termination is cantilevered from the non-symmetrical outer edge portion of the receiver, wherein said termination is adjacent to a tangential border that is co-incident with a tangential axis of said peripheral margin portion, also included in the cover is a plurality of separate and independent tension elements, each one having a terminal proximal end portion and a terminal distal end portion with a lengthwise axis spanning therebetween, each one of said plurality of tension elements has said distal end portion being independently removably engaged to a single aperture and has said proximal end portion being independently removably engaged to an oppositely disposed single aperture, each said tension element is adjacent to said axial axis such that each said lengthwise axis is perpendicular to said tangential axis, resulting in said plurality of tension elements extending radially outward in originating from said axial axis to said hem, operationally said plurality of tension elements each act to impart a completely independent tensile force upon said hem to further maintain a substantially planar shape of said panel within the non-symmetrical outer edge portion of the receiver;

(b) placing said panel over the dish opposite of the support structure;

(c) positioning said panel in relation to the dish such that a first selected aperture in said panel is positioned opposite of and facing the support structure, wherein said first selected aperture is adjacent to the dish outer edge portion;

(d) attaching therethrough said first selected aperture a first selected tension element;

(e) positioning said first selected tension element along said lengthwise axis to form one half of a "V" openly facing the support structure;

(f) attaching therethrough said first selected aperture a second selected tension element;

(g) positioning said second selected tension element along said lengthwise axis to form a remaining half of said "V" openly facing the support structure; and (h) securing distal end portions of each of said first and second selected tension elements to a second selected aperture and a third selected aperture respectively.

6. A method of installing a cover for a satellite dish receiver according to claim 5 further comprising a step of securing a proximal end portion and a distal end portion of a third selected tension element to a fourth selected aperture and a fifth selected aperture respectively.

7. A method of installing a cover for a satellite dish receiver according to claim 6 further comprising a step of adding said plurality of tension elements such that said distal end portions are each secured to an aperture and that said plurality of proximal end portions are each secured to a corresponding oppositely disposed aperture for each of said plurality of tension elements.

8. A method of installing a cover for a satellite dish receiver according to claim 7 further comprising a step of adjusting each said tensile force of each of said plurality of tension elements independently such that a coin will bounce off of said panel on a receiving side of the dish.

* * * * *